US010612298B1

(12) United States Patent
Jackson

(10) Patent No.: US 10,612,298 B1
(45) Date of Patent: Apr. 7, 2020

(54) LOCKABLE SLIDING SECURITY COVER FOR A DOOR

(71) Applicant: Raysha Jackson, Phoenix, AZ (US)

(72) Inventor: Raysha Jackson, Phoenix, AZ (US)

( * ) Notice: Subject to any disclaimer, the term of this patent is extended or adjusted under 35 U.S.C. 154(b) by 40 days.

(21) Appl. No.: 15/900,348

(22) Filed: Feb. 20, 2018

(51) Int. Cl.
*E06B 7/28* (2006.01)
*E06B 7/32* (2006.01)
*E06B 3/46* (2006.01)
*E05C 21/00* (2006.01)

(52) U.S. Cl.
CPC ..... *E06B 7/32* (2013.01); *E06B 3/4636* (2013.01); *E06B 3/4654* (2013.01); *E05C 21/00* (2013.01)

(58) Field of Classification Search
CPC ..... E06B 7/32; E06B 3/4636; E06B 3/4654; E05C 21/00
USPC ..... 49/168, 169, 170, 171
See application file for complete search history.

(56) References Cited

U.S. PATENT DOCUMENTS 1,186,565 A * 6/1916 Fogg ..... E06B 7/32 232/41 R
1,186,566 A * 6/1916 Fogg ..... E06B 7/32 232/41 R
1,369,270 A 2/1921 Durner
1,749,237 A 3/1930 Weinstein
2,488,724 A * 11/1949 Hengemel ..... E06B 7/30 49/171
2,550,856 A * 5/1951 Ouellet ..... B61D 19/002 222/460
2,774,116 A * 12/1956 Wolverton ..... E06B 7/28 137/493.1
3,203,052 A 8/1965 Curtis
3,745,957 A * 7/1973 Hendrickson ..... B63B 19/18 114/202
3,777,224 A * 12/1973 Meacham ..... H02B 1/06 361/643
3,885,348 A * 5/1975 Swearingen ..... E06B 5/003 49/171
4,001,970 A 1/1977 Miyamoto
4,053,007 A * 10/1977 Griffith ..... E06B 7/32 160/180
4,127,967 A * 12/1978 Franzl ..... E06B 7/28 16/82
4,384,376 A * 5/1983 Shrode ..... A47K 3/30 4/596
4,571,901 A 2/1986 Morris
(Continued)

FOREIGN PATENT DOCUMENTS

GB 2144469 A * 3/1985 ..... E06B 7/32
WO 2011042825 A 4/2011

*Primary Examiner* — Jerry E Redman
(74) *Attorney, Agent, or Firm* — Kyle A. Fletcher, Esq.

(57) ABSTRACT

The lockable sliding security cover for a door comprises a primary entrance and a Judas gate. The Judas gate installs in the primary entrance. The Judas gate is a security device. The Judas gate is a controlled aperture that is formed through the primary entrance. The Judas gate allows for the passage of small objects through the primary entrance without requiring that the primary entrance be opened such that a person can pass through the primary gate. The Judas gate is a lockable structure. When the Judas gate is in an open position, the Judas gate further forms a deadbolt structure within the primary entrance such that the primary entrance cannot be forced open while the Judas gate is open.

20 Claims, 4 Drawing Sheets

(56) References Cited

U.S. PATENT DOCUMENTS 4,700,556 A * 10/1987 Wade, Sr. ..... E05B 77/34 70/416
5,012,616 A * 5/1991 Martin ..... E06B 5/003 160/91
5,230,230 A * 7/1993 Horton ..... E05B 65/0082 109/63.5
5,579,605 A 12/1996 Tanaka
5,897,054 A 4/1999 Firth
5,992,096 A * 11/1999 De La Cerda ..... E05F 15/76 160/180
6,944,990 B2 * 9/2005 Noyes ..... E06B 7/32 119/484
8,284,071 B2 * 10/2012 Peng ..... B66B 13/26 340/556
8,302,348 B2 * 11/2012 Noyes ..... E05F 15/649 119/484
8,950,114 B1 * 2/2015 Groening ..... F41H 5/26 49/171
9,003,705 B1 * 4/2015 Solowiej ..... E06B 7/32 49/169
10,156,086 B2 * 12/2018 Hart ..... E05B 75/00
2003/0074841 A1 * 4/2003 Vesey ..... E06B 7/32 49/169
2004/0148865 A1 * 8/2004 Duncan ..... E05B 1/0015 49/415
2010/0269413 A1 * 10/2010 Sullivan ..... E06B 7/32 49/171
2013/0036672 A1 * 2/2013 Westerfield ..... E06B 7/32 49/62
2014/0373449 A1 * 12/2014 Woeltjen, Jr. ..... E06B 7/32 49/169
2016/0097228 A1 * 4/2016 Wypych ..... E05D 15/0656 16/90
2017/0362871 A1 * 12/2017 Walden ..... G08C 17/02
2018/0010380 A1 * 1/2018 Kapavik ..... E06B 3/4654

* cited by examiner

LOCKABLE SLIDING SECURITY COVER FOR A DOOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including doors, more specifically, a grille installed in a door that moves with the door.

SUMMARY OF INVENTION

The lockable sliding security cover for a door comprises a primary entrance and a Judas gate. The Judas gate installs in the primary entrance. The Judas gate is a security device. The Judas gate is a controlled aperture that is formed through the primary entrance. The Judas gate allows for the passage of small objects through the primary entrance without requiring that the primary entrance be opened such that a person can pass through the primary gate. The Judas gate is a lockable structure. When the Judas gate is in an open position, the Judas gate further forms a deadbolt structure within the primary entrance such that the primary entrance cannot be forced open while the Judas gate is open.

These together with additional objects, features and advantages of the lockable sliding security cover for a door will be readily apparent to those of ordinary skill in the art upon reading the following detailed description of the presently preferred, but nonetheless illustrative, embodiments when taken in conjunction with the accompanying drawings.

In this respect, before explaining the current embodiments of the lockable sliding security cover for a door in detail, it is to be understood that the lockable sliding security cover for a door is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lockable sliding security cover for a door.

It is therefore important that the claims be regarded as including such equivalent construction insofar as they do not depart from the spirit and scope of the lockable sliding security cover for a door. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
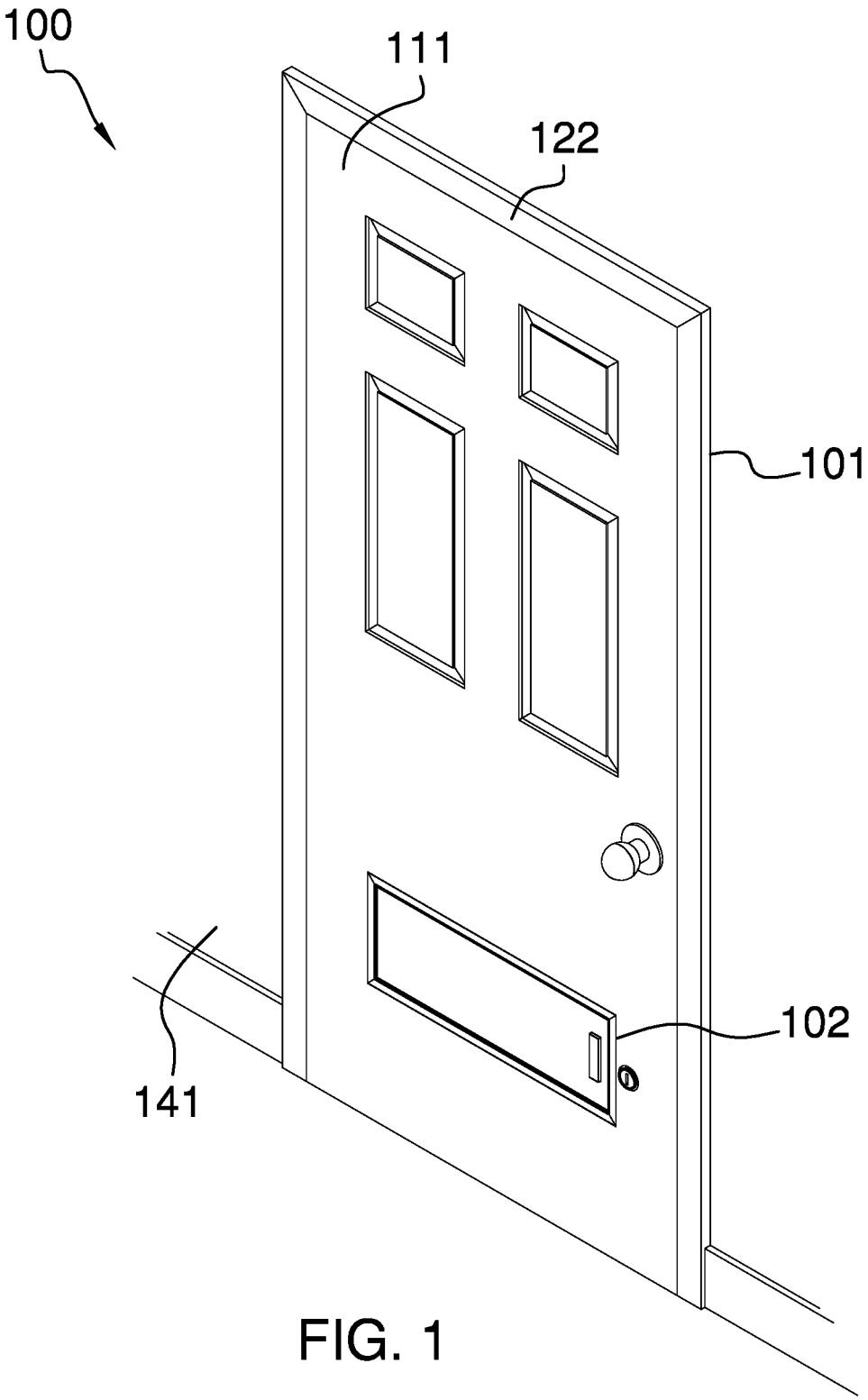
FIG. 1 is a closed perspective view of an embodiment of the disclosure.
Figure 2:
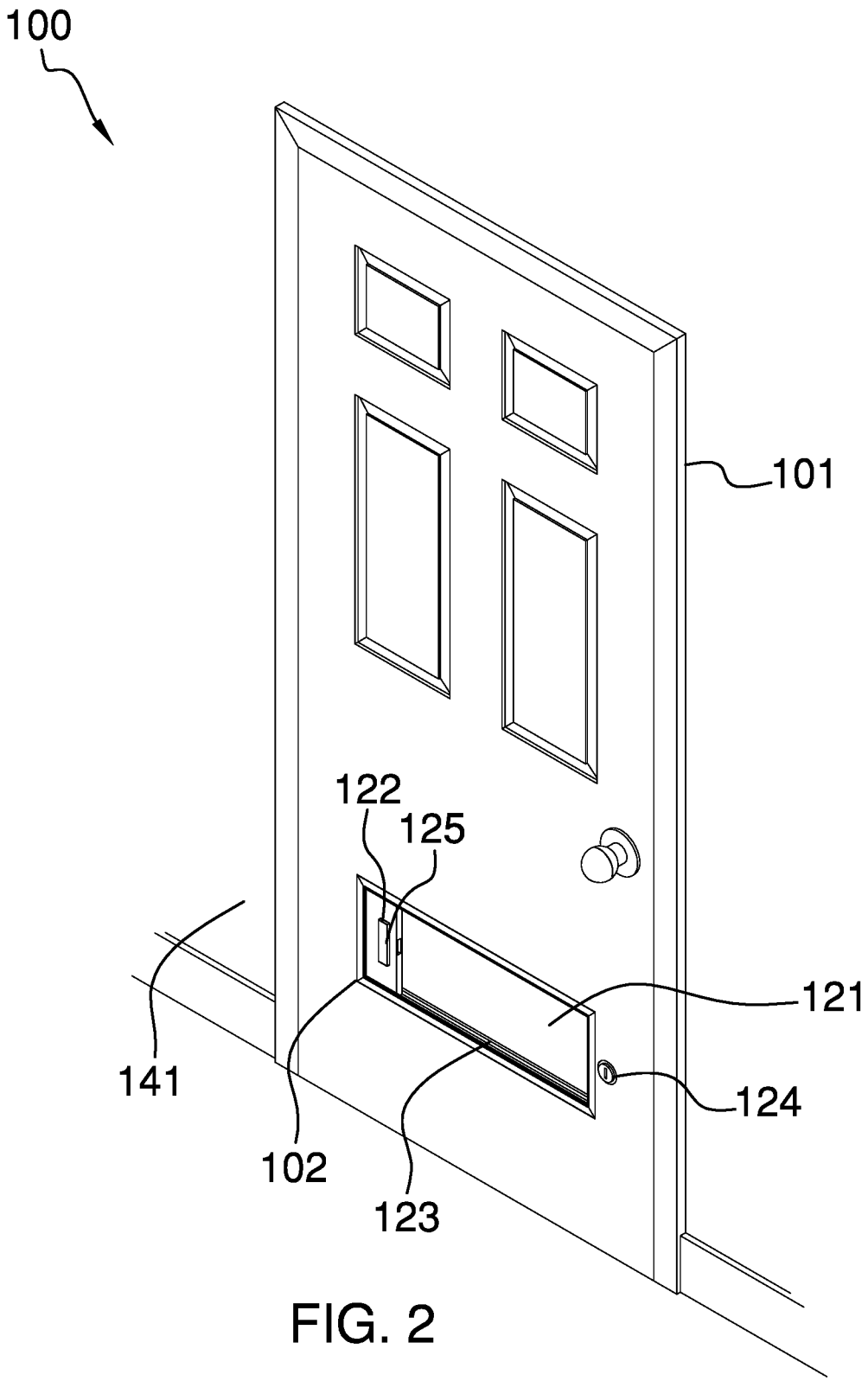
FIG. 2 is an open perspective view of an embodiment of the disclosure.
Figure 3:
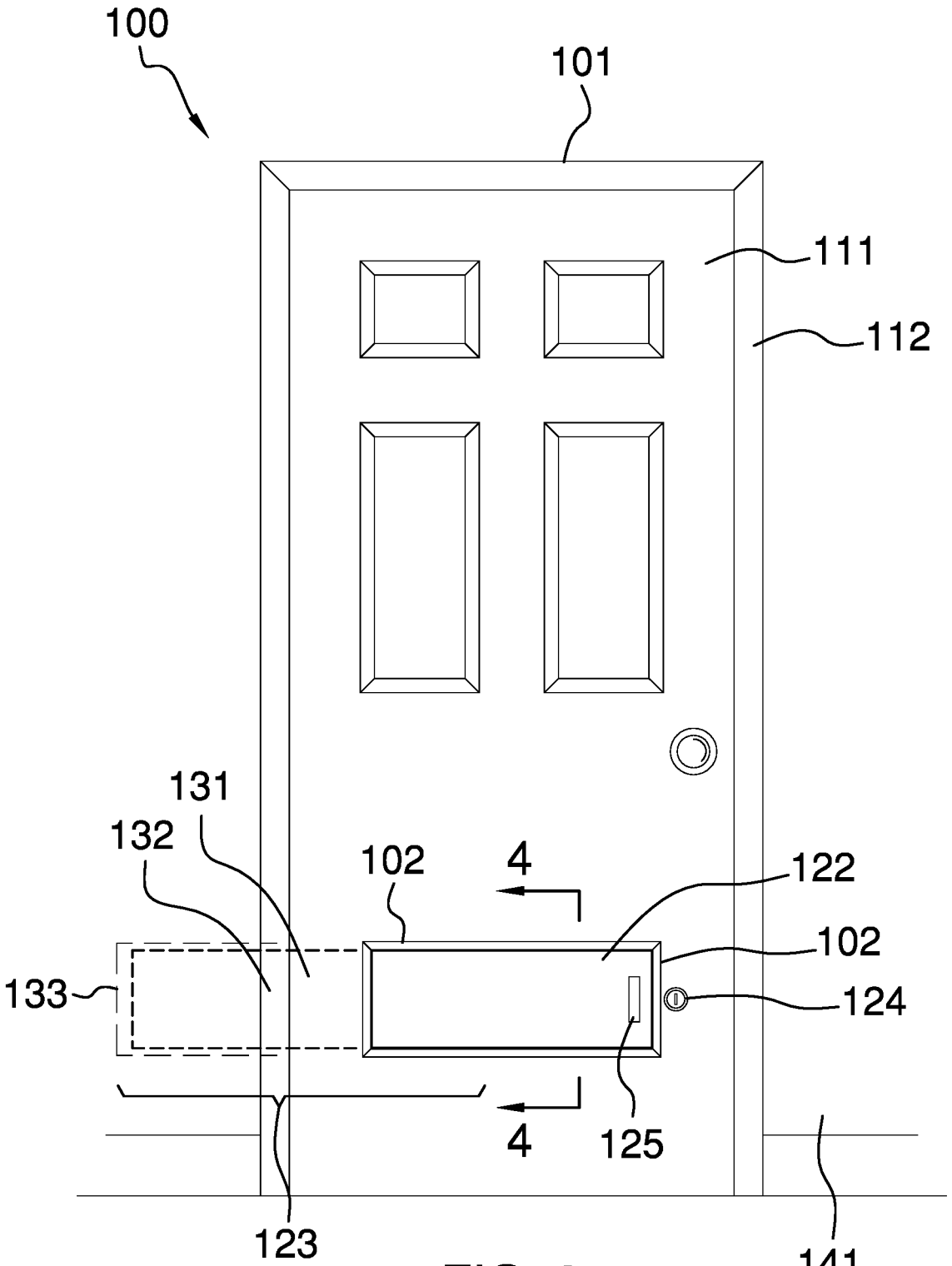
FIG. 3 is a front view of an embodiment of the disclosure.
Figure 4:
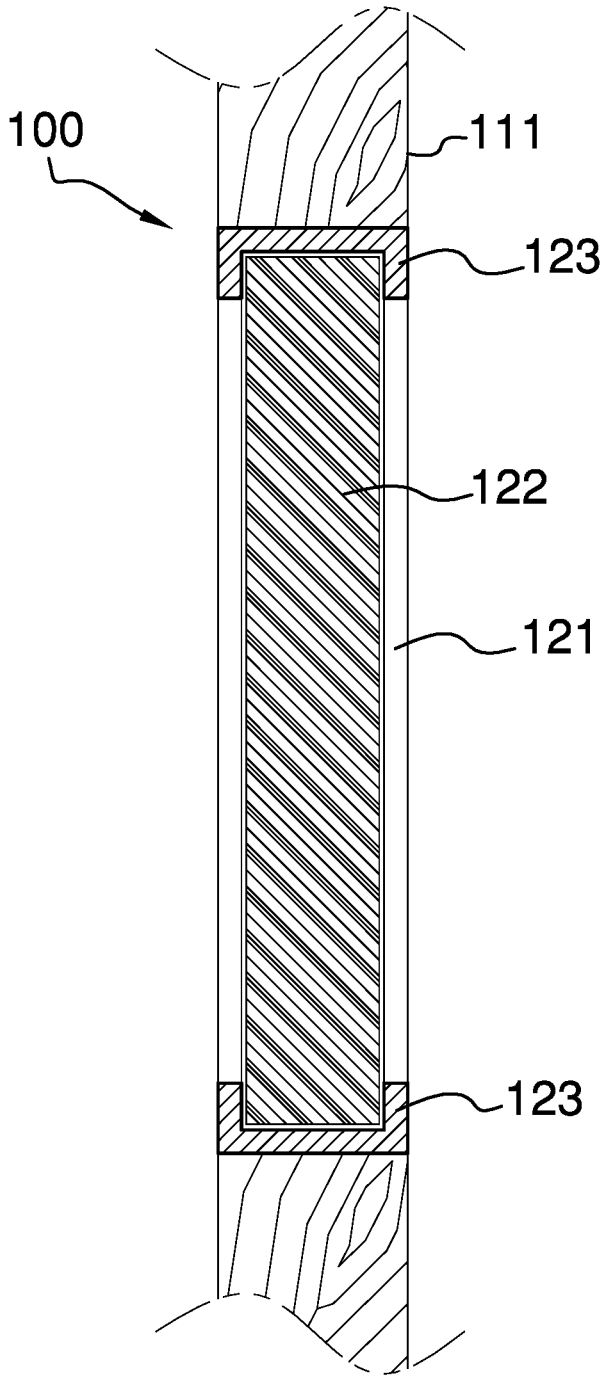
FIG. 4 is a cross-sectional view of an embodiment of the disclosure across 4-4 as shown in FIG. 3.

Detailed reference will now be made to one or more potential embodiments of the disclosure, which are illustrated in FIGS. 1 through 4.

The lockable sliding security cover for a door 100 (hereinafter invention) comprises a primary entrance 101 and a Judas gate 102. The Judas gate 102 installs in the primary entrance 101. The Judas gate 102 is a security device. The Judas gate 102 is a controlled aperture that is formed through the primary entrance 101. The Judas gate 102 allows for the passage of small objects through the primary entrance 101 without requiring that the primary entrance 101 be opened such that a person can pass through the primary gate. The Judas gate 102 is a lockable structure. When the Judas gate 102 is in an open position, the Judas gate 102 further forms a deadbolt structure within the primary entrance 101 such that the primary entrance 101 cannot be forced open while the Judas gate 102 is open.

The primary entrance 101 is a door that is formed through a vertical wall 141. In the first potential embodiment of the disclosure, the primary entrance 101 is a rectangular structure. The primary entrance 101 offers controlled access through the vertical wall 141. The primary entrance 101 comprises a primary door panel 111, a primary door frame 112, and a vertical wall 141.

The primary door panel 111 is a rotating barrier used to open and close the aperture formed by the primary entrance 101. The primary door panel 111 attaches to the primary door frame 112 using one or more hinges. The primary door panel 111 is formed as a plate structure.

The primary door frame 112 is a structural framework that is formed through the vertical wall 141. The primary door frame 112 forms the aperture through the vertical wall 141 that provides access through the vertical wall 141 when the primary entrance 101 is in an open position. The primary door frame 112 forms a structure around the perimeter of the aperture formed by the primary door frame 112 such that: 1) the primary door panel 111 attaches to the primary door frame 112; and, 2) the primary door panel 111 can be secured to the primary door frame 112 when the primary door panel 111 is in a closed position. The use of a primary door frame 112 and the installation of a primary door panel 111 in a primary door frame 112 are well-known and documented in the construction arts.

The vertical wall 141 is a vertical structure that separates an area into two smaller spaces. Methods to design and build a vertical wall 141 are well-known and documented in the construction arts.

The Judas gate 102 is an aperture structure that installs in the primary entrance 101. In the first potential embodiment of the disclosure, the Judas gate 102 is a rectangular structure. The Judas gate 102 provides controlled access through the primary entrance 101 while the primary entrance 101 remains in a closed position. The Judas gate 102 is designed to be opened and closed. The Judas gate 102 forms an aperture through which an object is passed. When open, the Judas gate 102 further forms a deadbolt structure that inserts into the primary entrance 101. When closed, the Judas gate 102 forms a lockable barrier that prevents access through the aperture of the Judas gate 102. The deadbolt structure of the Judas gate 102 locks the primary entrance 101 in a closed position such that the primary entrance 101 cannot be opened when the Judas gate 102 is open.

The Judas gate 102 comprises a Judas aperture 121, a Judas panel 122, a Judas frame 123, and a Judas locking mechanism 124.

The Judas aperture 121 is an aperture that is formed through the primary door panel 111. The Judas aperture 121 has a rectangular shape.

The Judas panel 122 is a plate. The Judas panel 122 forms a barrier that opens and closes the access through the Judas aperture 121. The Judas panel 122 has a rectangular shape. The outer dimension of the Judas panel 122 is greater than the inner dimension of the Judas aperture 121 such that the Judas panel 122 forms a barrier from within the Judas aperture 121. The Judas panel 122 installs in the Judas frame 123 such that the position of the Judas panel 122 within the Judas aperture 121 adjusts by adjusting the relative position of the Judas panel 122 within the Judas frame 123. The Judas panel 122 further comprises a Judas handle 125. The Judas handle 125 is a grip that is installed on the Judas panel 122. The Judas handle 125 is used to move the Judas panel 122 between an open position and a closed position.

The Judas locking mechanism 124 is a commercially available locking device. The Judas locking mechanism 124 is installed in the primary entrance 101 such that the Judas panel 122 can be locked in a closed position when the Judas gate 102 is not in use.

The Judas frame 123 is a coordinated negative space that is formed: 1) in the Judas panel 122; 2) through the Judas frame 123; and, 3) in the vertical wall 141. The inner dimensions of the Judas frame 123 are greater than the outer dimensions of the Judas panel 122 such that the Judas panel 122 will fit in the Judas frame 123. The Judas frame 123 forms a track, which guides the motion of the Judas panel 122 within the Judas frame 123. Methods to form tracks within structures are well-known and documented in the mechanical arts.

The Judas frame 123 comprises a primary door Judas track 131, a primary frame Judas track 132, and a vertical wall 141 Judas track 133.

The primary door Judas track 131 is a rectangularly shaped negative space formed in the primary door panel 111. The primary door Judas track 131 is positioned such that the Judas aperture 121 passes through the primary door Judas track 131.

The primary frame Judas track 132 is a rectangularly shaped negative space formed through the primary door frame 112 from the primary door Judas track 131 to the vertical wall 141. The primary frame Judas track 132 is positioned such that the primary door Judas track 131 is aligned with the primary frame Judas track 132. The alignment of the primary door Judas track 131 with the primary frame Judas track 132 is such that the Judas panel 122 will slide from the primary door Judas track 131 into and through the primary frame Judas track 132.

The vertical wall 141 Judas track 133 is a rectangularly shaped negative space formed in the vertical wall 141. The vertical wall 141 Judas track 133 is positioned such that the primary door Judas track 131 and the primary frame Judas track 132 are aligned with the vertical wall 141 Judas track 133. The alignment of the vertical wall 141 Judas track 133 with the primary door Judas track 131 and the primary frame Judas track 132 is such that the Judas panel 122 will slide from the primary door Judas track 131 through the primary frame Judas track 132 and into the vertical wall 141 Judas track 133.

When the Judas gate 102 is in an open position, the Judas panel 122 is simultaneously contained within the primary door Judas track 131, the primary frame Judas track 132 and the vertical wall 141 Judas track 133 of the Judas frame 123. When the Judas panel 122 is in this position, the Judas panel 122 forms a deadbolt structure that prevents the primary door panel 121 from opening. When the primary door panel 111 of the primary entrance 101 is in an open position, the alignment between the primary door Judas track 131, the primary frame Judas track 132 and the vertical wall 141 Judas track 133 is lost thereby preventing the Judas gate 102 from opening.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Closed Position: As used in this disclosure, a closed position refers to a movable barrier structure that is in an orientation that prevents passage through a port or an aperture. The closed position is often referred to as an object being "closed."

Door: As used in this disclosure, a door is a movable or removable barrier that is attached to the wall of a room or the surface of a container for the purpose of allowing or preventing access through an aperture into the room or container.

Framework: As used in this disclosure, a framework refers to the substructure of an object that carries the load path of the object.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Dimension: As used in this disclosure, the term inner dimension describes the span from a first inside or interior surface of a container to a second inside or interior surface of a container. The term is used in much the same way that a plumber would refer to the inner diameter of a pipe.

Judas Gate: As used in this disclosure, a Judas gate refers to a second door that is installed in a first door. The second door is referred to as the Judas gate. The Judas gate is a security device that allows for partial access through the door without requiring the opening of the first door.

Lock: As used in this disclosure, a lock is a fastening device that is released through the use of a key, a numeric or alphanumeric combination, or a biometric identification protocol.

Negative Space: As used in this disclosure, negative space is a method of defining an object through the use of open or empty space as the definition of the object itself, or, through the use of open or empty space to describe the boundaries of an object.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal, plastic, and wood. When made of wood, a plate is often referred to as a board.

Slide: As used in this disclosure, slide is a verb that refers to an object that is transported along a surface while in continuous contact with the surface. An object being transported along a surface with wheels cannot be said to be sliding.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A lockable sliding security cover for a door comprising:
- a primary door and a Judas gate;
- wherein the Judas gate installs in the primary door;
- wherein the Judas gate is formed through the primary door;
- wherein the Judas gate allows passage of objects through the primary door when the primary door is closed;
- wherein the Judas gate is a lockable structure;
- wherein the Judas gate further forms a deadbolt structure within the primary door such that when the primary door is closed and the Judas gate is open and extends within a vertical wall.

2. The lockable sliding security cover for a door according to claim 1
- wherein the primary door is formed through a vertical wall;
- wherein the vertical wall is a vertical structure that bifurcates an area;
- wherein the primary door is a rectangular structure;
- wherein the Judas gate is a rectangular structure;
- wherein the Judas gate controls access through the primary door while the primary door is in a closed position;
- wherein the Judas gate opens and closes;
- wherein the Judas gate is lockable.

3. The lockable sliding security cover for a door according to claim 2
- wherein the primary door comprises a primary door panel, a primary door frame, and a vertical wall;
- wherein the primary door panel is a rotating barrier;
- wherein the primary door frame forms an aperture;
- wherein the primary door panel attaches to the primary door frame.

4. The lockable sliding security cover for a door according to claim 3
- wherein the primary door panel is secured to the primary door frame when the primary door panel is in a closed position.

5. The lockable sliding security cover for a door according to claim 4 wherein the Judas gate comprises a Judas aperture, a Judas panel, a Judas frame, and a Judas locking mechanism;

wherein the Judas frame forms the Judas aperture;

wherein the Judas frame contains the Judas panel;

wherein the Judas locking mechanism secures the Judas panel in a closed position.

6. The lockable sliding security cover for a door according to claim 5 wherein the Judas aperture is an aperture that is formed through the primary door panel;

wherein the Judas aperture has a rectangular shape.

7. The lockable sliding security cover for a door according to claim 6 wherein the Judas panel forms a barrier that opens and closes the access through the Judas aperture.

8. The lockable sliding security cover for a door according to claim 7 wherein the Judas panel is a plate;

wherein the Judas panel has a rectangular shape.

9. The lockable sliding security cover for a door according to claim 8 wherein the outer dimension of the Judas panel is greater than the inner dimension of the Judas aperture such that the Judas panel forms a barrier from within the Judas aperture.

10. The lockable sliding security cover for a door according to claim 9 wherein the Judas panel installs in the Judas frame such that the position of the Judas panel within the Judas aperture adjusts by adjusting the relative position of the Judas panel within the Judas frame.

11. The lockable sliding security cover for a door according to claim 10 wherein the Judas locking mechanism is installed in the primary door such that the Judas panel can be locked in a closed position when the Judas gate is not in use.

12. The lockable sliding security cover for a door according to claim 11 wherein the Judas frame is a coordinated negative space that is formed: a) in the Judas panel; b) through the Judas frame; and, c) in the vertical wall.

13. The lockable sliding security cover for a door according to claim 12 wherein the inner dimensions of the Judas frame are greater than the outer dimensions of the Judas panel such that the Judas panel will fit in the Judas frame.

14. The lockable sliding security cover for a door according to claim 13 wherein the Judas frame forms a track, which guides the motion of the Judas panel within the Judas frame.

15. The lockable sliding security cover for a door according to claim 14 wherein the Judas frame comprises a primary door Judas track, a primary frame Judas track, and a vertical wall Judas track;

wherein the primary frame Judas track connects the primary door Judas track to the vertical wall Judas track.

16. The lockable sliding security cover for a door according to claim 15 wherein the primary door Judas track is a rectangularly shaped negative space formed in the primary door panel;

wherein the primary frame Judas track is a rectangularly shaped negative space formed through the primary door frame from the primary door Judas track to the vertical wall;

wherein the vertical wall Judas track is a rectangularly shaped negative space formed in the vertical wall.

17. The lockable sliding security cover for a door according to claim 16 wherein the primary door Judas track is positioned such that the Judas aperture passes through the primary door Judas track.

18. The lockable sliding security cover for a door according to claim 17 wherein the vertical wall Judas track is positioned such that the primary door Judas track and the primary frame Judas track are aligned with the vertical wall Judas track;

wherein the alignment of the vertical wall Judas track with the primary door Judas track and the primary frame Judas track is such that the Judas panel will slide from the primary door Judas track through the primary frame Judas track and into the vertical wall Judas track.

19. The lockable sliding security cover for a door according to claim 18 wherein when the Judas gate is in an open position, the Judas panel is simultaneously contained within the primary door Judas track, the primary frame Judas track and the vertical wall Judas track of the Judas frame thereby forming the deadbolt structure;

wherein when the primary door panel of the primary door is in an open position, the alignment between the primary door Judas track, the primary frame Judas track, and the vertical wall Judas track is lost thereby preventing the Judas gate from opening.

20. The lockable sliding security cover for a door according to claim 19 wherein the Judas panel further comprises a Judas handle;

wherein the Judas handle is a grip that is installed on the Judas panel;

wherein the Judas handle is used to move the Judas panel between an open position and a closed position.

* * * * *